US006640990B2

(12) United States Patent
Saito et al.

(10) Patent No.: US 6,640,990 B2
(45) Date of Patent: Nov. 4, 2003

(54) BOTTLE-TYPE PLASTIC CONTAINER WITH LONGITUDINALLY VARIABLE GRIP WIDTH TO ACCOMMODATE MULTIPLE HAND SIZES

(75) Inventors: Hiromichi Saito, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/058,308

(22) Filed: Jan. 30, 2002

(65) Prior Publication Data

US 2002/0162820 A1 Nov. 7, 2002

(30) Foreign Application Priority Data

Jan. 31, 2001 (JP) ..... 2001-023126

(51) Int. Cl.[7] ..... B65D 23/10
(52) U.S. Cl. ..... 215/384; 215/383; 220/669
(58) Field of Search ..... 215/381, 382, 215/384, 398, 383, 379; 220/771, 669; D9/530, 540–553

(56) References Cited

U.S. PATENT DOCUMENTS

| | | | | | |
|---|---|---|---|---|---|
| D277,551 | S | * | 2/1985 | Kerr | 215/384 X |
| 4,610,366 | A | * | 9/1986 | Estes et al. | 215/383 X |
| 5,837,170 | A | * | 11/1998 | Valyi | 215/6 X |
| D433,947 | S | * | 11/2000 | Ewing, Jr. | D9/543 |
| 6,164,474 | A | * | 12/2000 | Cheng et al. | 215/382 X |

FOREIGN PATENT DOCUMENTS

| | | |
|---|---|---|
| JP | Y2 4-33238 | 8/1992 |
| JP | Y2 4-33239 | 8/1992 |

* cited by examiner

*Primary Examiner*—Sue A. Weaver
(74) *Attorney, Agent, or Firm*—Oliff & Berridge, PLC

(57) ABSTRACT

A bottle-type plastic container includes a container body and an opening at one end of the container body for allowing liquid contents to be charged into the container and discharged therefrom. The container body has surface portions, which are recessed inwards and opposed to each other to define a grip region therebetween. The grip region has a width that changes gradually in a longitudinal direction of the container body, so that the container can be readily and stably held by hand regardless of the hand size.

6 Claims, 4 Drawing Sheets

BOTTLE-TYPE PLASTIC CONTAINER WITH LONGITUDINALLY VARIABLE GRIP WIDTH TO ACCOMMODATE MULTIPLE HAND SIZES

BACKGROUND OF THE INVENTION

1. Field of Invention

The present invention relates a bottle-type plastic container having a container body that is partly recessed inwards to afford a grip region.

2. Description of Related Art

As a bottle-type container for beverages, alcoholic drinks, etc., a relatively large size plastic container is often used, having a capacity of 2,700 $cm^3$, for example, and produced by a biaxial orientation blow molding process or the like.

The body of such container is large and heavy in use, and is thus not always easy to stably hold by a single band. Therefore, it has been a conventional practice to provide such a container with a separately prepared grip member that is fixedly secured to the body. However, provision of separate grip member is not very suitable solution from the viewpoint of reduction in production steps, cost and material. Furthermore, so-called separated collection of waste materials becomes difficult or time consuming, particularly when the body and the grip member are comprised of mutually different materials and, hence, the grip member has to be removed from the body before disposition.

These problems can be effectively eliminated by a pinch grip-type container including a body that is partly recessed inwards to afford a grip region, as disclosed, for example, in JP-4-33,238Y2 or JP-4-33,239Y2. In this instance, the container body has surface portions that are recessed inwards and opposed to each other to define a grip region therebetween, which is configured so as to be engaged by consumer's hand. Such an arrangement proved to be highly advantageous in that a plastic container with an integral grip region can be produced efficiently and at low cost, without requiring a separate grip member to be prepared in advance and subsequently connected to the container body.

On the other hand, however, there is a problem in the pinch grip-type container in that, depending upon size of consumer's hand, the container may not be readily and stably held by hand. It is highly desirable to eliminate such a problem of the prior art.

SUMMARY OF THE INVENTION

It is therefore an object of the present invention to provide an improved bottle-type plastic container, which eliminates the above-mentioned problems of the prior art, and which includes an integral grip portion allowing the container to be readily and stably held by consumer's hand, regardless of size of hand.

To this end, according to the present invention, a bottle-type plastic container comprises a body and an opening at one end of the container that allows liquid contents to be charged into the container and discharged therefrom. The container body has surface portions that are recessed inwards and opposed to each other to define a grip region therebetween. The grip region has a width that changes gradually in a longitudinal direction of the container body.

With the above-mentioned arrangement of the bottle-type plastic container according to the present invention, since the grip region has a width that changes gradually in a longitudinal direction of the container body, it is readily possible for the consumer to find out an optimum position where the grip region is engaged and held by hand, regardless of the size of hand, by moving the hand relative to, the grip region, in the longitudinal direction of the container body either upwards or downwards.

It is preferred that the width of the grip region gradually decreases toward an upper end or a lower end of the container body.

The container according to the present invention may have an inner volume within a range of 1,800–4,000 $cm^3$.

BRIEF DESCRIPTION OF THE DRAWINGS

The present invention will be explained below in further detail, with reference to a preferred embodiment shown in the drawings.

DETAILED DESCRIPTION OF THE PREFERRED EMBODIMENT

Figure 1:
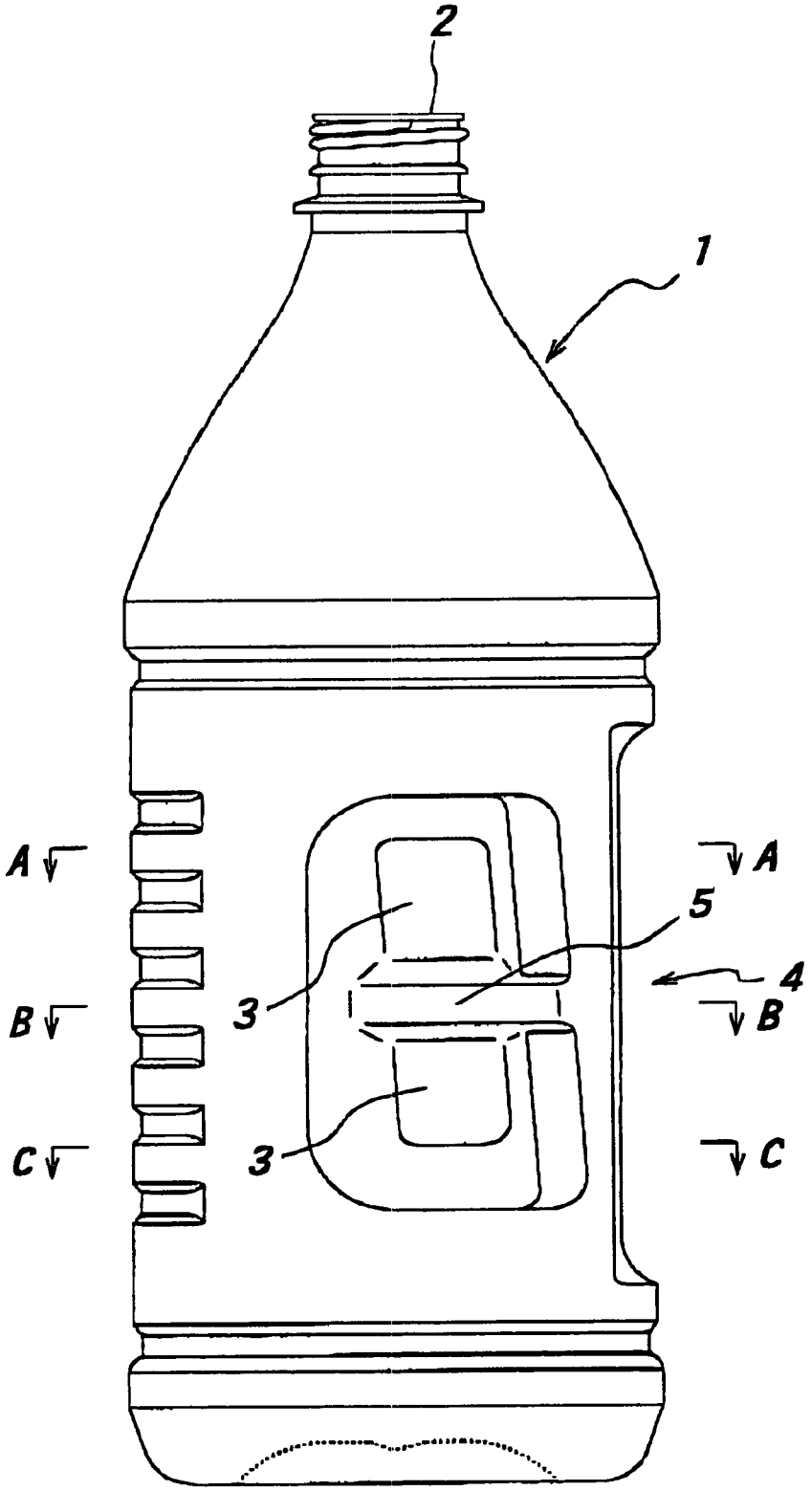
FIGS. 1 and 2 are side view and rear view, respectively, of the bottle-type plastic container according to one embodiment of the present invention.
Figure 2:
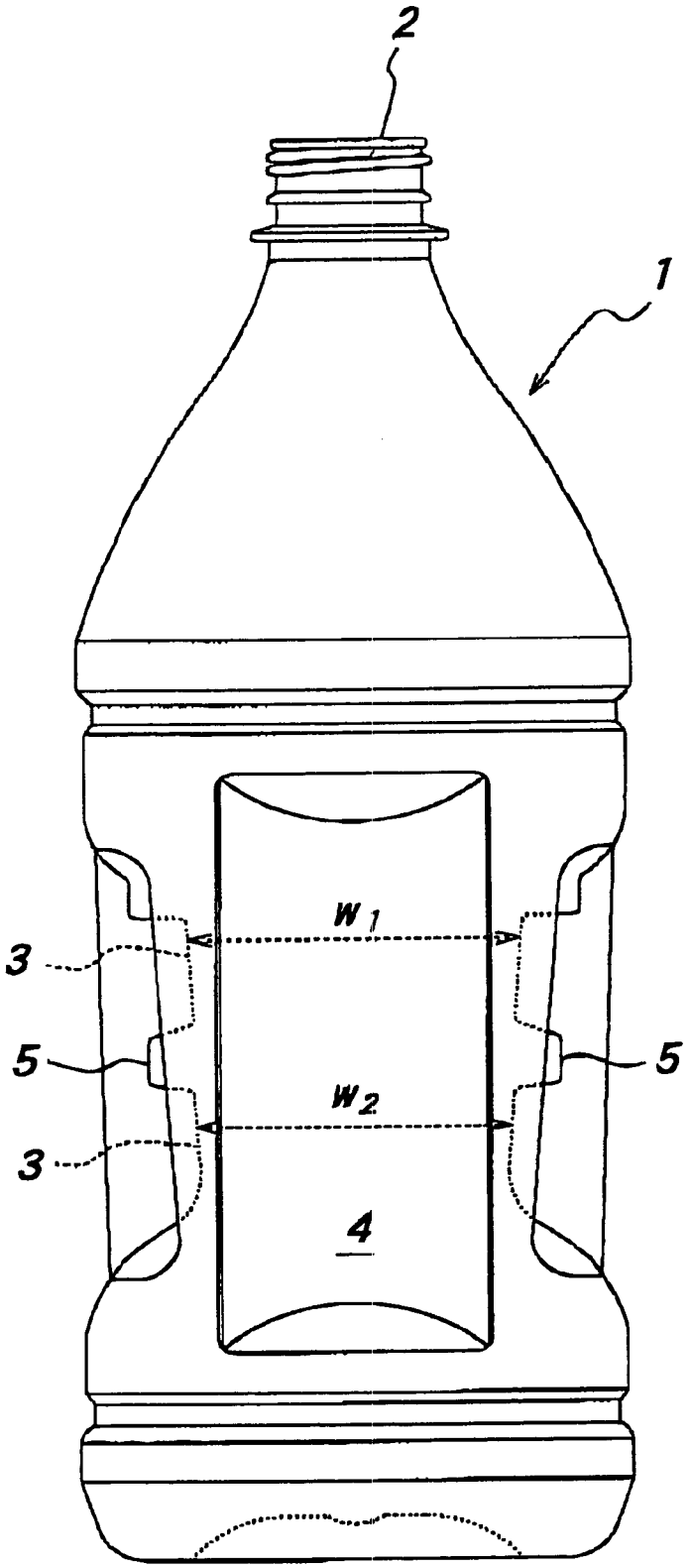
Figure 3A:
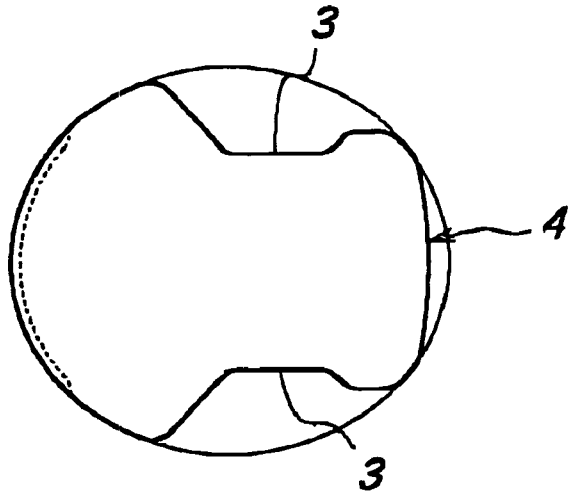
FIGS. 3*a*, 3*b* and 3*c* are schematic sectional views taken along the lines A—A, B—B and C—C in FIG. 1, respectively.
Figure 3B:
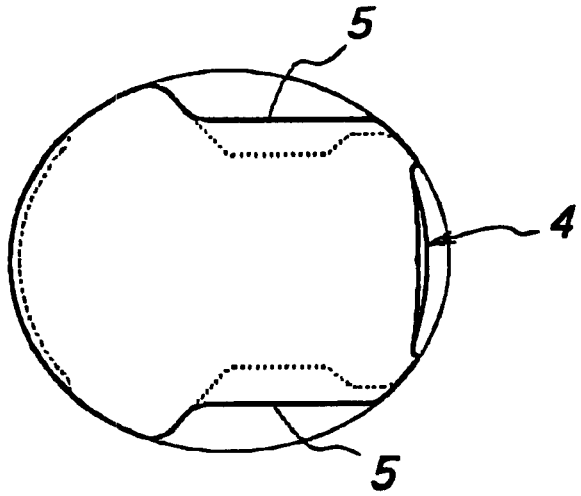
Figure 3C:
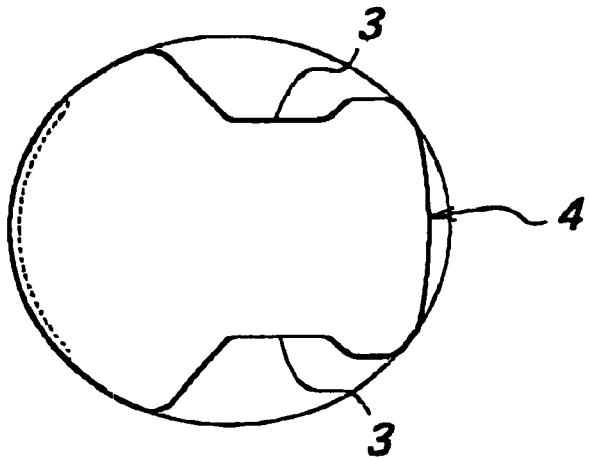

Referring now to FIGS. 1 and 2, there is shown a bottle-type plastic container according to one embodiment of the present invention. The container includes a substantially cylindrical container body designated as a whole by reference numeral 1. An opening 2 is formed at an upper end region of the container body 1, for allowing the container to be filled with liquid contents and emptied therefrom. For the sake of convenience, it is assumed that the container has an inner volume of 2,700 $cm^3$.

The container according to the present invention may be made of an appropriate synthetic resin, typically a saturated polyester-type thermoplastic resin having a sufficient resistance to chemicals, such as polyethylene terephthalate (PET) resin, polybuthylene terephthalate resin or polyethylene naphthalate resin. The container may be formed by known molding processes, such as biaxial orientation blow molding process or direct blow molding process. The container may be made of a single layer of the above-mentioned resin, or three or five layers comprised of outer and inner layers of the above-mentioned resin with one or more barrier layers therebetween. In this instance, the barrier layers may be comprised of polyimide resin or ethylene vinyl alcohol copolymer (EVOH) resin. When the container is made of a single layer, it may be comprised of a blend of the above-mentioned polyester resin and the barrier resin.

The container body 1 includes front and rear surface portions, of which the front surface portion serves as an ornamental portion either in the form of a printed surface, or bearing a heat shrink label or the like, indicating visual information such as trademark or the like. On the other hand, as shown in FIG. 1, both sides of the rear surface portion of the container body 1 are recessed inwards to provide depressions 3 on opposite sides, for defining a grip region 4 therebetween. As can be appreciated from FIG. 2, the grip region 4 in the rear surface portion is in the form of a panel that allows a limited deformation of the grip region 4 when being grasped by hand, or when the liquid content within the container is subjected to change in temperature.

Conventionally, the width of the grip region in a pinch grip-type container as measured in the circumferential direction of the container body is substantially constant in the longitudinal direction of the container body. According to the present invention, in contrast, the grip region 4 has a width that changes gradually in the longitudinal direction of the container body 1.

More particularly, in the embodiment shown in FIG. 2, the width of the grip region 4 gradually decreases toward the lower end of the body so that the width W1 on the upper part of the grip region 4 is larger than the width W2 on the lower part. The upper part of the grip region 4 having a relatively large width W1 can be suitably held by a relatively large band, whereas the lower part of the grip region 4 having a relatively small width W2 can be suitably held by a relatively a small hand.

Since the grip region 4 has a width that changes gradually in a longitudinal direction of the container body 1, it is readily possible for the consumer to find out an optimum position where the grip region 4 is held by hand, regardless of the size of hand, by moving the hand relative to the grip region 4, in the longitudinal direction of the container body 1 either upwards or downwards.

At the middle of the depression 3, a reinforcing rib 5 is integrally provided to extend in the circumferential direction of the container body 1, and thereby preserve the required rigidity and strength of the container body 1. The front surface portion and/or the panel-like region may also be formed with reinforcements in the form of ribs or grooves, whenever necessary to provide further enhanced rigidity or strength of the container body 1.

Provision of the reinforcing rib 5 at the middle of the depression 3 not only preserves the required rigidity and strength of the container body 1, but also forms a clear boundary between the relatively wide part and relatively narrow part of the grip region 4, for indicating by a finger touch as to which of these parts the consumer is going to grasp.

Figure 4:
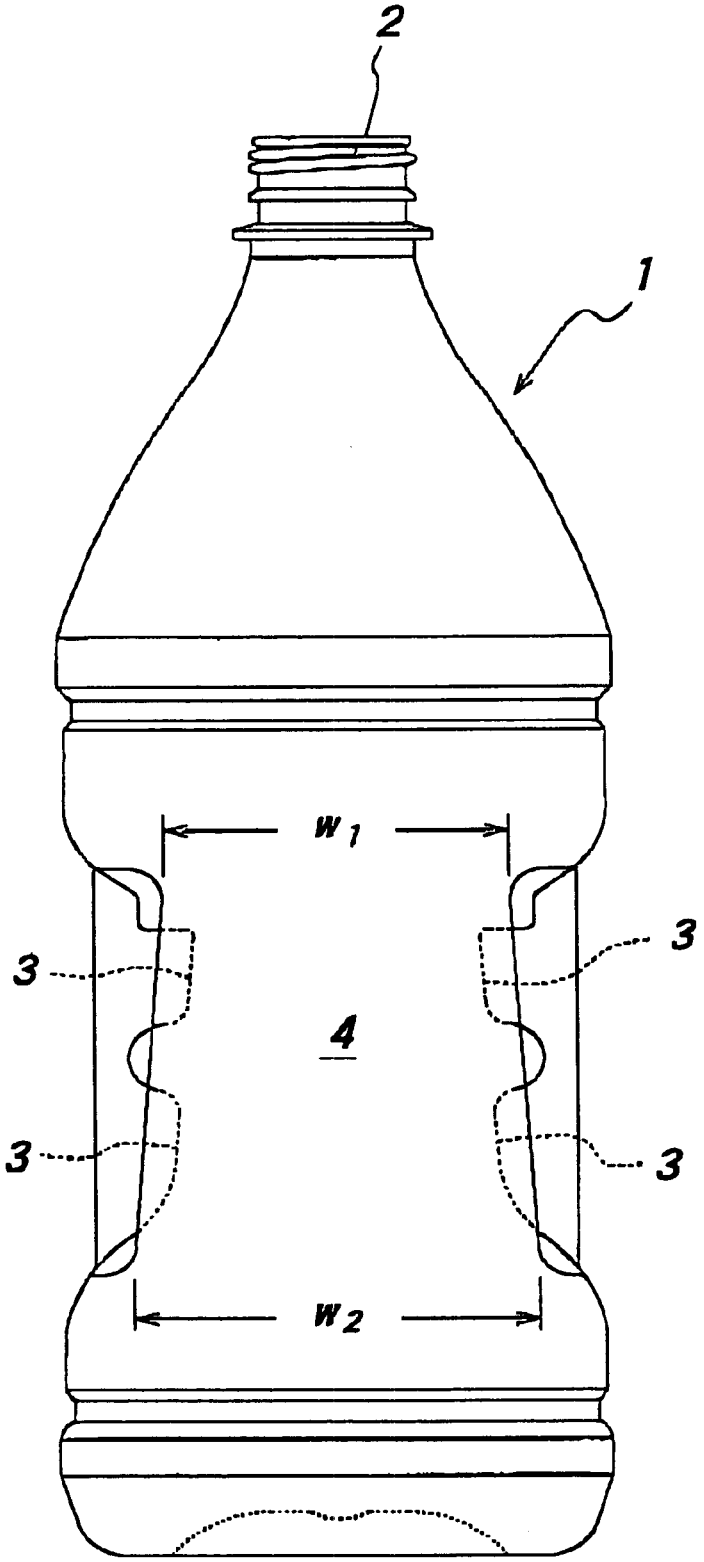
FIG. 4 is a rear view of the bottle-type plastic container according to another embodiment of the present invention.

Another embodiment of the pinch grip-type plastic container according to the present invention, which differs from the previous embodiment in that the width of the grip region 4 gradually decreases toward the upper end of the container body 1 so that the width W1 on the upper part of the grip region 4 is smaller than the width W2 on the lower part. In this instance, the upper part of the grip region 4 having a relatively small width W1 can be suitably held by a relatively small hand, whereas the lower part of the grip region 4 having a relatively large width W2 can be suitably held by a relatively a large hard. Thus, the embodiment shown in FIG. 4 also makes it readily possible for the consumer to find out an optimum position where the grip region 4 is held by hand, regardless of the size of hand, by moving the hand relative to the grip region 4, in the longitudinal direction of the container body 1 either upwards or downwards.

While the present invention has been described above with reference to a specific embodiment, various changes and/or modifications may be made without departing from the scope of the invention as defined by the appended claims.

What is claimed is:

1. A bottle-type plastic container comprising a container body and an opening at one end of the container body, for allowing liquid contents to be charged into the container and discharged therefrom, said container body having surface portions which are recessed inwards and opposed to each other to define opposed depressions, a circumferentially extending reinforcing rib being provided within each depression to divide each depression into an upper and a lower portion, and a grip region defined between the opposed depressions, wherein the grip region has a width that changes gradually in a longitudinal direction of the container body so that the combination of the upper portion of each depression and a corresponding upper portion of the grip region define a first gripping area sized to fit a hand of a first size and the combination of the lower portion of each depression and a corresponding lower portion of the grip region define a second gripping area sized to fit a hand of a second, different size.

2. The bottle-type plastic container according to claim 1, wherein the width of the grip region gradually decreases toward an upper end of the container body.

3. The bottle-type plastic container according to claim 1, wherein the width of the grip region gradually decreases toward a lower end of the container body.

4. The bottle-type plastic container according to claim 1, wherein said container has an inner volume within a range of 1,800–4,000 $cm^3$.

5. The bottle-type plastic container according to claim 1, wherein said reinforcing rib is located at substantially the middle of each depression.

6. The bottle-type plastic container according to claim 1, wherein the upper portion and the lower portion of each depression have substantially the same inward recession amount.

* * * * *